US005531176A

United States Patent [19]

Johnson

[11] Patent Number: 5,531,176

[45] Date of Patent: Jul. 2, 1996

[54] METHOD OF MAKING AN APPLIQUÉ

[76] Inventor: Adrienne M. Johnson, 201 Country Club Rd., Laconia, N.H. 03246

[21] Appl. No.: 258,615

[22] Filed: Jun. 16, 1994

[51] Int. Cl.[6] ..... D05B 1/24; B32B 7/08; B32B 7/14

[52] U.S. Cl. ..... 112/475.24; 112/439; 112/475.21; 156/93; 428/79; 428/542.2

[58] Field of Search ..... 112/475.01, 403, 112/417, 439, 405, 475.21, 475.24, 475.18; 156/93; 223/52, 44; 2/245, 246, 244, 243.1; 28/163; 428/79, 542.2, 906.6, 914

[56] References Cited

U.S. PATENT DOCUMENTS

| | | | |
|---|---|---|---|
| 1,723,729 | 8/1929 | Goldberg | 112/404 X |
| 2,922,167 | 1/1960 | Berlin | 2/245 |
| 3,137,864 | 6/1964 | Ostmann, Jr. | 2/243.1 |
| 3,390,036 | 6/1968 | Wright et al. | 156/93 |
| 3,406,407 | 10/1968 | Parlanti | 2/243.1 |
| 3,898,943 | 8/1975 | Braden et al. | 112/475.01 |
| 4,395,964 | 8/1983 | Warren | 112/475.01 |
| 4,427,472 | 1/1984 | Trager | 156/93 |
| 4,596,616 | 6/1986 | Noda et al. | 156/93 |
| 5,141,140 | 8/1992 | Moffett-Hall | 223/52 |
| 5,421,919 | 9/1993 | LaGreca | 2/244 X |

OTHER PUBLICATIONS

"Which Applique Technique Shall I Use?," *Quilter's Newsletter Magazine,* pp. 38–39 (Jun. 1989).

"Appliqué," *Needlework Nostalgia,* Ed. by Barbara Weiland, Butterick Publishing, pp. 85–87 (1975).

"Appliqué Basics," *Better Homes and Gardens Appliqué,* pp. 6–9 (1978).

"Teach Yourself To Quilt," *Leisure Arts Craft Leaflets,* Leaflet No. 1179, pp. 8–10, 12–14 (1988).

"General Directions," *Quilting Today,* pp. 16 (Fall 1989).

"Glossary of Techniques," *Red and Green—An Applique Traditional,* by Jean A. Kimball, That Patchwork Place, pp. 38–39 (Jun. 1989).

"Appliquè," *The Great Noank Quilt Factory,* by Sharon McKain, pp. 47–49 (1974).

"Quilters' GluTube," rubber cement, photocopy of instructions on back side of blisterpack, 1989.

*Primary Examiner*—Ismael Izaguirre
*Attorney, Agent, or Firm*—Nies, Kurz, Bergert & Tamburro

[57] ABSTRACT

A method for making applique elements without the need for a light box, and without the need for tracing outlines of the applique elements onto the applique fabric materials. A pre-printed paper sheet is provided having outlines of the appliqué elements printed thereon in non-transferable ink. The back surface of the paper sheet is coated with a low softening temperature coating, such as a wax or a polymeric coating having a low heat softening temperature to releasably attach the cut, printed appliqué elements to the back of the appliqué fabric material. The appliqué elements are cut from the sheet of appliqué material and are releasably adhered to the back or wrong side of the appliqué fabric by pressing with a warm iron. An adhesive coating is applied to the seam allowance and to the peripheral edge of the template, and appliqué elements are cut from the appliqué material sheet together with the seam allowance, which is then folded over the template edge to adhere the seam allowance to the template. The appliqué elements can then be attached to the desired base material in the usual manner.

8 Claims, 2 Drawing Sheets

METHOD OF MAKING AN APPLIQUÉ

BACKGROUND OF THE INVENTION

1. Field of the Invention

The present invention relates to a method for making an appliqué to be applied as a decorative overlay on a larger fabric, or on a fabric covered article. More particularly, the present invention relates to an improved, more rapid method for making an appliqué by eliminating the need for stiff or rigid separate templates, by eliminating the need for manually tracing the outline of an appliqué element onto fabric sections from which the appliqué element is to be formed, and by eliminating the need for a light box to facilitate such tracing operations.

2. Description of the Related Art

Appliqué designs are commonly provided as decorative elements on various types of fabric articles, such as quilts, tablecloths, bedspreads, pillow cases, and the like. Traditionally, appliqué elements have been made and applied by hand, and the technique required the tracing onto the back surface of the appliqué fabric material of the outline of the appliqué element, which is a tedious and time-consuming process, especially when the overall appliqué design includes a number of individual appliqué elements that are to be combined to provide the overall design.

After allowing an amount of fabric for a seam allowance around the outer periphery of the traced appliqué element, the element is cut from the fabric sheet, and the seam allowance is folded over along the traced peripheral outline of the element and is basted. The resulting appliqué element is then arranged in position on the base material to which it is to be attached, either alone or together with other appliqué elements, to form the final appliqué design on the base material.

Because the traditional method for making the appliqué elements by tracing and for providing finished edges by basting is so slow, various different approaches have been devised to facilitate the preparation of such appliqué elements, and to reduce the time involved in preparing them. One such different approach involved the use of preformed templates defining the outlines of the several appliqué elements, both with and without the seam allowance. The templates are often made from either a thick plastic sheet, that has a thickness greater than that of a limp film, or from a heavy paper sheet that has sufficient weight to be substantially self-supporting. The template that includes the seam allowance is placed over the fabric sheet from which the appliqué element is to be formed, and is secured thereto temporarily either by tape or by means of a readily releasible adhesive, after which the pattern for the appliqué element is cut from the fabric, along with the desired seam allowance. The element is then either sewn to a second template without the seam allowance, if the material is paper, or alternatively, it is attached using a water-soluble glue. The resulting appliqué element is then stitched to the base material, which has had drawn on it using the smaller template, without the seam allowance, the outline of the appliqué element. The smaller template is later removed by cutting the base material that is positioned under the appliqué element and is within the periphery of the element, and separating the paper or plastic template frown the appliqué element and withdrawing it from between the appliqué material and the base material.

Other ways that have been devised for holding the seam allowances in place include the application of a spray starch to the fabric portion of the seam allowance and then ironing the seam allowance over the reverse side of the appliqué element or over a previously-cut paper template placed on the reverse side of the appliqué element fabric. Additionally, the use of a so-called freezer paper, having a heat softenable coating, has been suggested with the coating surface of the template facing upwardly so that the folded over fabric seam allowance can be ironed directly to the coated surface of the freezer paper.

Several of the proposed template and seam allowance attachment techniques are described in an article that appeared in the June 1989 issue of *Quilters Newsletter Magazine*. The article is entitled, "Which Appliqué Technique Shall I Use", and it appeared on pages 38 and 39. Other techniques are disclosed in the Background of the Invention section of U.S. Pat. No. 5,141,140, which issued on Aug. 25, 1992 to Deborah J. Moffett-Hall.

Although some of the alternative techniques for preparing appliqué elements significantly speed the process, as compared with the traditional method involving tracing and basting, they still involve excessive time and are tedious to use. It is therefore an object of the present invention to provide an improved method for making an appliqué element, one that does not require the tracing of the outline of the appliqué element onto a fabric section, and that therefore eliminates the need for a light box to facilitate such tracing operations.

It is another object of the present invention to provide an improved appliqué element preparation method that eliminates the need for basting the seam allowance directly to the fabric, or for attaching the seam allowance to a paper or plastic template.

SUMMARY OF THE INVENTION

Briefly stated, in accordance with one aspect of the present invention, a method is provided for preparing a fabric pattern element having a desired shape for attachment to a fabric base material to provide a decorative effect to the fabric base material. The outline of the appliqué element is printed on one side of a paper sheet, so that the appliqué element can be cut from the sheet to eliminate the need for tracing and for a light box. One face of the paper sheet is coated with a thin, heat softenable coating that has a softening temperature greater than normal room temperature, so that the coating can be activated by a common home iron. The appliqué element is cut from the paper sheet to provide a paper template having a coated face and an uncoated face. The paper template is associated with a respective material from which the appliqué element is to be formed, and is placed on the respective fabric sheet, on the reverse side of the sheet, with the coated face of the template against the reverse face of the fabric sheet and with the uncoated face of the template facing outwardly. Heat and pressure are applied substantially uniformly over the uncoated base of the template to soften the heat softenable coating to releasably adhere the coated face of the template to the fabric sheet. Thereafter a layer of releasable adhesive is applied along the outer peripheral edge portion of the uncoated face of the paper template to provide a continuous strip of adhesive coated surface adjacent to the peripheral edge of the uncoated face of the paper template. A layer of the releasable adhesive is also placed along an adjacent portion of the fabric sheet adjacent the peripheral edge of the template to provide a substantially continuous strip of adhesive coated surface extending onto the fabric sheet and onto the peripheral side of the template. After the releasable adhesive has dried the fabric sheet is cut around the peripheral edge of the paper template at a substantially uniform, predetermined spacing therefrom to provide a fabric seam allowance around and outwardly around the paper template. The fabric seam allowance is then folded over the peripheral edge of the paper template and against the uncoated face of the paper template to adhere the adhesive coated portion of the fabric to the peripheral, adhesive coated surface of the paper template to secure the seam allowance in position against the paper template. The appliqué element is then attached to the base material at a desired position, either alone or in conjunction with other appliqué elements, which are then secured in position by sewing the respective appliqué elements to the base material.

DESCRIPTION OF THE PREFERRED EMBODIMENTS

Figure 1:
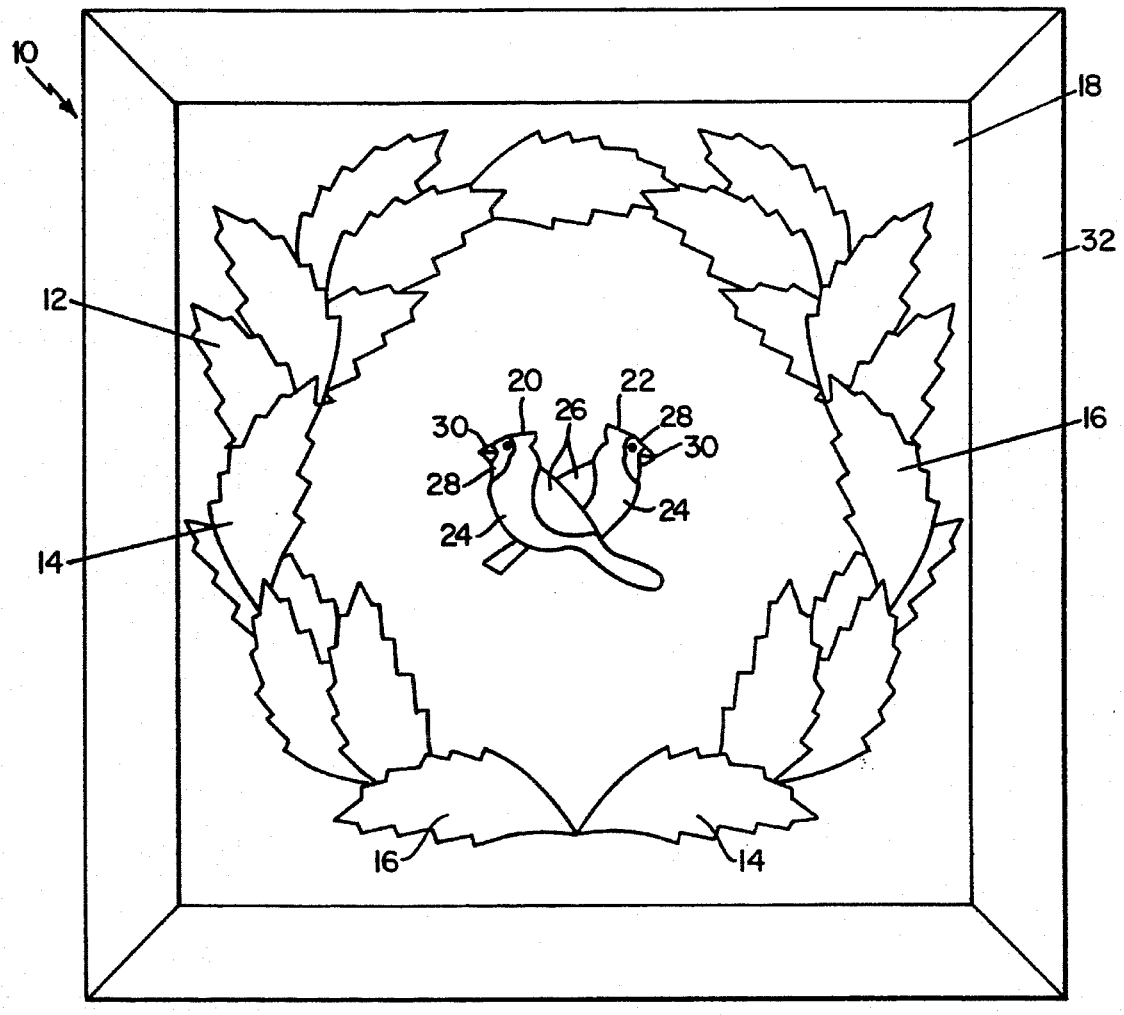
FIG. 1 is a plan view of one form of appliqué design in the form of a plurality of appliqué elements arranged to provide a holly wreath defined by a plurality of circularly arranged holly leaves, with a pair of oppositely facing cardinals positioned within the interior of the holly wreath.

Referring now to the drawings, and particularly to FIG. 1 thereof, there is shown an illustrative design 10 for an appliqué in the form of a circular holly wreath 12 defined by a plurality of individual holly leaves 14, 16 that are secured to and arranged on a base sheet 18 of fabric material to define the desired design. As shown, design 10 includes right hand holly leaves 14 and left hand holly leaves 16, a plurality of which are arranged in partially overlapping form in a generally circular arrangement to provide the complete wreath 12. Positioned within the interior of wreath 12 are a pair of oppositely facing cardinals 20, 22, that are also defined by several individual elements including a body portion 24, a wing portion 26, a face portion 28, and a beak portion 30. Optionally, a fabric border 32 can also be provided.

Design 10 shown in FIG. 1 has been devised for forming one of a number of panels on a quilt, although the particular design can also be utilized in other contexts, such as either alone or together with other panel designs on bedspreads or tablecloths. Additionally, the design can also be applied to a pillowcase for a throw pillow, or the like.

Figure 2:
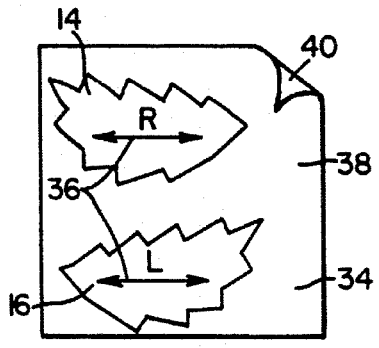
FIG. 2 is a top plan view of a printed paper sheet on which the outlines of the respective appliqué elements are printed, one surface of which sheet is coated with a heat softenable coating, and from which templates are cut.

In accordance with the present invention, the outlines of the several design elements forming part of the overall appliqué design are printed on a sheet of intermediate weight paper, preferably having a basis weight of from about 16 to about 20 lb. per ream, (about 35.2 to about 44 kg. per ream) and using a non-transferable ink, in order not to leave an ink residue on the appliqué fabric and in order to avoid possible bleed-through of ink onto the front surface of the appliqué material. As shown in FIG. 2, both right hand holly leaves 14 and left hand holly leaves 16 have been printed on such a paper sheet 34, and included within each of the printed outlines is an orientation arrow 36 to properly orient the respective leaf elements with respect to the grain of the appliqué fabric. The printing of the appliqué element outlines and fabric grain directions are preferably applied to one face 38 of the paper sheet, and a thin, heat softenable coating is applied uniformly to the opposite face 40 of sheet 34. The purpose of the heat softenable coating is to permit temporary and releasable adhesion of an appliqué element template, such as holly leaves 14 and 16, to the fabric sheet from which the appliqué element is to be cut. Because the heat softenable coating is intended to provide only a temporary, preferably a releasable, bond to the appliqué fabric, the coating can be a thin, wax coating, or, preferably, a thin, polymeric coating having a relatively low heat softening temperature, so that the coating will soften when heated by a conventional home iron that can be set at various predetermined heat settings for use on particular fabrics. The polymeric coating material could be a low density polyethylene, a vinyl polymer or copolymer, or the like. As applied to the paper sheet, the coating preferably has a thickness of the order of about 0.003 inches (about 0.076 mm) or so.

In the course of preparing the several appliqué elements to form the desired design, initially each printed element is cut from the paper sheet, along the printed edges, to define an appliqué element template, such as holly leaf 14. Although hereinafter referred to in the singular, it should be understood that several appliqué elements will normally be worked on simultaneously.

Figure 3:
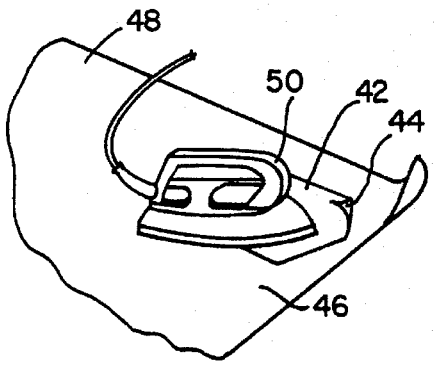
FIG. 3 is a fragmentary perspective view showing how templates cut from the template sheet material are applied to a sheet of fabric material from which an appliqué element is to be formed.

As shown in FIG. 3, the coated surface 44 of template 42 is then placed on the back surface 46 of the selected appliqué fabric material 48 that is to be placed against the outer surface of base material 18. Back surface 46 of the appliqué fabric material on which template 42 is placed is sometimes referred to as the "wrong side" of the fabric. After alignment of template 42 so that the directional arrow printed thereon is aligned with the direction of the grain of appliqué fabric material 48, and with the coated surface 44 of template 42 against back surface 46 of appliqué fabric material 48, a warm iron 50 is lightly pressed against the upwardly facing, uncoated surface of template 42 to cause the coating on the opposite side of template 42 to soften and thereby temporarily adhere template 42 substantially uniformly over back surface 46 of appliqué fabric material 48.

Figure 4:
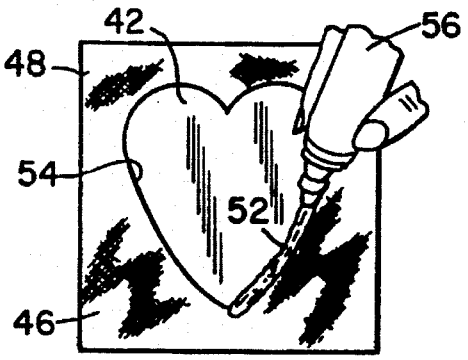
FIG. 4 is a plan view of the reverse side of the appliqué fabric sheet, with the cut template in position, and showing the application of a releasable, flexible adhesive to the periphery of the template and to the seam allowance portion of the appliqué fabric.

After template 42 has been temporarily attached to the back surface 46 of appliqué fabric material 48, using the proper fabric setting for iron 50, the fabric and template are allowed to cool. After cooling, and as shown in FIG. 4, a peripheral strip 52 of a peelable adhesive is applied adjacent the peripheral edge 54 of template 42, and on the upwardly facing portion thereof. The strip 52 of adhesive is of sufficient width to extend both on the surface of the paper template 42, as well as on the adjacent surface of the fabric 48. Preferably, the total width of adhesive strip 52 is of the order of about 3/16 to about ¼ inch (about 4.76 to about 6.35 mm.) on each side of peripheral edge 54 of template 42, giving a total width of adhesive covered surface of about ⅜ to about ½ inch (about 9.53 to about 12.7 mm.).

The desired adhesive coating on both the peripheral edge of paper template 42 and on the immediately surrounding portion of appliqué fabric sheet 48 can conveniently be formed in a continuous, substantially uniform width strip directly from a collapsible tube that contains the adhesive. In applying the adhesive coating as shown in FIG. 4, a circular motion of the dispensing opening of a collapsible tube 56 containing the adhesive material is used to direct the tube opening over the adjacent portions of template 42 and also of the fabric sheet. As it is being moved in a circular direction, tube 56 is simultaneously moved in a generally linear direction along the peripheral edge of template 42, while gently squeezing the tube to dispense its contents, to apply the desired thin layer of adhesive coating. The coating is substantially uniformly applied, and is preferably very thin, only sufficient to cover the surfaces without excessive buildup, because the coating readily adheres to itself after drying. Only sufficient adhesive need be applied to form a thin uniform, dull surface upon drying.

The adhesive coating that is applied adjacent the peripheral edge 54 of template 42 and onto the surrounding portion of the appliqué fabric material 48 is preferably one that will readily release from the appliqué fabric material after the adhesive has dried, while remaining adhered to the paper surface, to permit the adhesive and template to be ultimately conveniently separated from the appliqué fabric material without tearing either the paper or the fabric. An example of a suitable adhesive material for that purpose is rubber cement, which can be provided either in the form of a collapsible tube, as shown in FIG. 4, to permit the application technique as hereinabove described. Alternatively, the adhesive can be applied by a brush that can be provided as a part of a closure cap for a bottle containing the rubber cement. If a collapsible tube is employed, advantageously the dispensing opening of the tube can contain a dispensing ball (not shown) to provide the desired thin layer of adhesive material.

Figure 5:
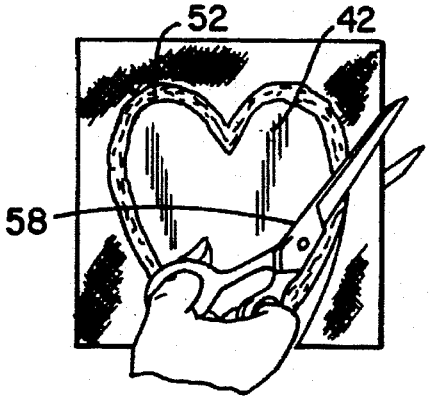
FIG. 5 is a view similar to FIG. 4 after the adhesive has been applied, showing how the excess appliqué fabric material is trimmed from around the appliqué template and seam allowance.

The rubber cement is allowed to dry, after which the excess, uncoated portion of the appliqué fabric material 48 around the template is cut therefrom, such as by the use of a scissor 58 as illustrated in FIG. 5. The cutting of the appliqué fabric material 48 occurs outwardly of peripheral edge 54 of template 42, and along the outermost edge of adhesive layer 52, so that the amount of fabric between peripheral edge 54 and the cut fabric edge defines a convenient seam allowance.

Figure 6:
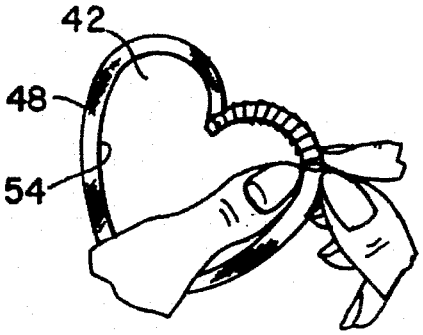
FIG. 6 is a plan view showing the step of manually folding over the entire seam allowance so that the respective adhesive coated surfaces of the fabric and template are brought into contact to hold the seam allowance in position against the outer face of the template.

After the appliqué element has been cut from the appliqué fabric sheet, the seam allowance outwardly of peripheral edge 54 of template 42 is folded over the template edge, as shown in FIG. 6, so that the adhesive coated portion of appliqué fabric material 48 adheres to the adhesive coated portion of template 42. The resulting appliqué element is then ready for attachment to base fabric material 18 as shown in FIG. 1, in the desired position to form a part of the desired design. A plurality of such separate appliqué design elements can be held in place temporarily by rubber cement applied to the outwardly facing surface of paper template 42 to hold the appliqué element in position on the fabric base sheet 18. The respective appliqué elements can then be sewn to the fabric base material in any convenient manner, such as by stitching the appliqué element to the fabric base material using thread having a color that substantially matches the color of the appliqué fabric material through which the stitches pass adjacent the periphery of the appliqué element. In that connection, the stitching is accomplished without sewing through the paper template, so that the stitches, which are preferably blind stitches, pass through the appliqué fabric material and the fabric base sheet.

Figure 7:
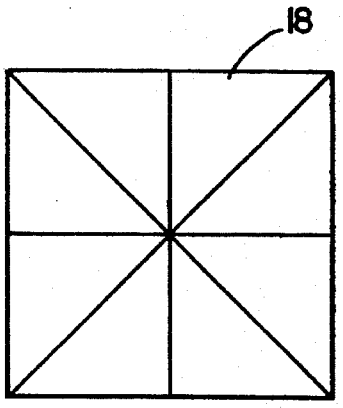
FIG. 7 is a plan view showing the results of folding a sheet of base material to define the center of the sheet and several diagonals thereof, to facilitate placement of individual appliqué elements to form a predetermined design.
Figure 8:
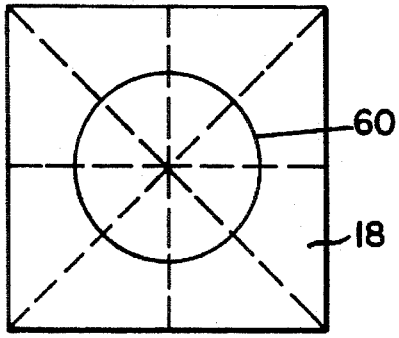
FIG. 8 is a plan view similar to FIG. 7, showing a positioning circle that has been lightly drawn on the base material to orient the several holly leaves that form a part of the appliqué design shown in FIG. 1.

One way of enabling the proper orientation of the respective appliqué elements on the fabric base material involves folding the base material in half twice and then folding it diagonally once to provide a plurality of fold lines such as shown in FIG. 7. The fold pattern illustrated permits identification of the geometric center of the base fabric material sheet, and provides a convenient center point from which to properly arrange the respective appliqué elements. In the case of the circular wreath design shown in FIG. 1, a suitable positioning circle 60 of predetermined diameter can be provided on base material sheet 18 as shown in FIG. 8, and can be drawn by means of a compass, a plate having the desired diameter, or the like.

After each of the desired appliqué elements that have been prepared as described above have been secured to the fabric base material in the proper position, the paper template and the attached rubber cement can be removed together by first cutting through the fabric base material on the back surface thereof, beneath the appliqué element. A suitable opening is formed by trimming the fabric base material adjacent the edge of the appliqué element to provide an opening large enough to permit access to the paper template. The paper template is then gently pulled from the back, or inner, surface of the appliqué fabric. Because the rubber cement that was applied to the appliqué fabric has adhered to the rubber cement that was applied to the paper template, and because the rubber cement is readily separable from the appliqué fabric material, both the template and rubber cement are simultaneously removed from the appliqué fabric material, leaving a clean inner appliqué surface.

It can thus be seen that the present method provides a convenient and rapid way for preparing appliqué elements for application to a base material. Further, the appliqué elements are prepared without the need for a light box, without the need for tracing patterns, without the need for separate templates, and without the need for tedious basting of the edges of the appliqué fabric material.

Although particular embodiments of the present invention have been illustrated and described, it will be apparent to those skilled in the art that various changes and modifications can be made without departing from the spirit of the present invention. Accordingly, it is intended to have encompassed within the appended claims all such changes and modifications that fall within the scope of the present invention.

What is claimed is:

1. A method for preparing an appliqué element having a desired shape for attachment to a fabric base material to provide a decorative effect to the fabric base material, said method comprising:

a. providing a sheet of flexible fabric material from which an appliqué element is formed, the fabric material having a fabric grain and having a desired color and a desired decorative design, the sheet having a front face to face outwardly when the appliqué element has been prepared, and a back face to face against the fabric base material when the appliqué element is attached to the base material;

b. providing a paper sheet having printed thereon in a non-transferable ink an outline of a shape element of which a fabric pattern element is to be made, wherein the paper sheet includes on one face thereof a heat softenable coating having a softening temperature greater than normal room temperature;

c. cutting the paper sheet along the printed outline to separate the shape element from the paper sheet and provide a paper template having a coated face and an uncoated face;

d. placing the paper template on the flexible fabric sheet with the coated face of the template against the back face of the fabric sheet and with the uncoated paper face of the paper template facing outwardly;

e. applying heat and pressure substantially uniformly over the uncoated face of the template to soften the heat softenable coating without transfer of ink from the paper template to the fabric sheet to releasably adhere the coated face of the template to the fabric sheet;

f. applying a layer of releasable adhesive along the outer peripheral edge portion of the uncoated face of the paper template and along an adjacent portion of the fabric sheet adjacent the peripheral edge of the paper template to provide a substantially continuous strip of adhesive coated surface on the paper template adjacent to the peripheral edge of the uncoated face of the paper template and on the fabric sheet outwardly of and adjacent to the peripheral edge of the paper template;

g. cutting the fabric sheet around the peripheral edge of the paper template at a substantially uniform, predetermined spacing therefrom to provide a fabric seam allowance around and outwardly of the periphery of the paper template;

h. folding the fabric seam allowance over the peripheral edge of the paper template and against the paper template on the uncoated face thereof to adhere the adhesive coated surface portion of the fabric sheet to the adhesive coated surface portion of the peripheral edge of the paper template to provide an appliqué element; and i. attaching the appliqué element to the fabric base material.

2. A method in accordance with claim 1 wherein the releasable adhesive is peelable from the fabric sheet.

3. A method in accordance with claim 2 wherein the releasable adhesive is rubber cement.

4. A method in accordance with claim 1 wherein the step of attaching the appliqué element to the fabric base material includes stitching the appliqué element to the fabric base material with thread using a blind stitch.

5. A method in accordance with claim 4 wherein the stitching passes only through the appliqué element and the fabric base material and does not pass through the paper template.

6. A method in accordance with claim 5 including the step of cutting the fabric base material under the appliqué element to provide an opening adequate to permit removal of the paper template.

7. A method in accordance with claim 6 including the step of pulling the paper template from the back side of the appliqué fabric material.

8. A method in accordance with claim 1 including the step of printing a fabric grain orientation indicator within the outline of the shape element to enable orientation of the shape element with the fabric grain of the fabric material of which a fabric pattern element is to be made.

* * * * *